US006649232B2

(12) United States Patent
Ito et al.

(10) Patent No.: US 6,649,232 B2
(45) Date of Patent: Nov. 18, 2003

(54) RECORDING SHEET

(75) Inventors: Akio Ito, Kanuma (JP); Jun Takahashi, Kanuma (JP); Yukiko Murasawa, Kanuma (JP); Hideaki Takahashi, Kanuma (JP)

(73) Assignee: Sony Chemicals Corp. (JP)

( * ) Notice: Subject to any disclaimer, the term of this patent is extended or adjusted under 35 U.S.C. 154(b) by 24 days.

(21) Appl. No.: 10/000,175

(22) Filed: Oct. 23, 2001

(65) Prior Publication Data

US 2002/0076531 A1 Jun. 20, 2002

(30) Foreign Application Priority Data

Oct. 24, 2000 (JP) ..... 2000-323869

(51) Int. Cl.[7] ..... B41M 5/00
(52) U.S. Cl. ..... 428/32.13
(58) Field of Search ..... 428/195, 206, 428/323, 446, 474.4, 480, 32.13, 32.25

(56) References Cited

U.S. PATENT DOCUMENTS

| | | | | | |
|---|---|---|---|---|---|
| 4,367,264 | A | * | 1/1983 | Hosaka et al. | 428/413 |
| 4,642,247 | A | * | 2/1987 | Mouri et al. | 427/214 |
| 4,775,658 | A | * | 10/1988 | Matsuda et al. | 503/227 |
| 4,877,678 | A | * | 10/1989 | Hasegawa et al. | 428/216 |
| 4,877,712 | A | * | 10/1989 | Namiki et al. | 430/256 |
| 4,931,423 | A | * | 6/1990 | Uemura et al. | 503/227 |
| 5,059,983 | A | * | 10/1991 | Higuma et al. | 346/1.1 |
| 5,762,743 | A | * | 6/1998 | Nakamura | 156/235 |
| 5,968,689 | A | * | 10/1999 | Torikoshi et al. | 430/18 |

FOREIGN PATENT DOCUMENTS

| | | | |
|---|---|---|---|
| EP | 0 286 427 | 10/1988 | B41M/1/30 |
| EP | 1 080 936 A2 | 3/2001 | B41M/5/00 |
| JP | 62-280068 | 12/1987 | B41M/5/00 |
| WO | WO 97/15455 | 5/1997 | B41M/5/00 |

OTHER PUBLICATIONS

Sekisui Chemicals Co., Ltd. web site, properties and technical data.*
Patent Abstracts of Japan, Publication No. 62–280068, published Dec. 4, 1987, 1 page.
European Search Report, dated Jul. 26, 2002, 3 pages.
Patent Abstracts of Japan, Publication No. 62280068, Publication Date Dec. 4, 1987, 1 page.
"Test Methods for Acid Value, Saponification value, Ester Value, Iodine Value, Hydroxyl Value and Unsaponifiable Matter of Chemical Products" as published in the Japanese Industrial Standard, JIS K 0070–1992, as translated by Japanese Standards Association (21 pages).

* cited by examiner

*Primary Examiner*—Bruce H. Hess
*Assistant Examiner*—B. Shewareged
(74) *Attorney, Agent, or Firm*—Rosenthal & Osha L.L.P.

(57) ABSTRACT

A recording sheet for use with inkjet printers which achieves high color density while being free of bleeding is provided. The recording sheet has an ink-receiving layer and an ink permeable layer arranged on a surface of the ink-receiving layer. The ink permeable layer includes a filler, a surfactant, and a binder. The surfactant includes a fluorosurfactant having perfluoro-alkyl groups in its chemical structure. The ink permeable layer is made hydrophobic as well as lipophobic since hydrophilic groups on the surfaces of the filler particles will be covered by perfluoro-alkyl groups of the fluorosurfactant. This prevents aqueous ink added an organic solvent from dispersing within the ink permeable layer. The ink permeable layer includes a binder containing a water-insoluble resin having a hydroxyl value of 4 or higher (mgKOH/g) to lower the affinity to the ink.

10 Claims, 1 Drawing Sheet

RECORDING SHEET

BACKGROUND OF THE INVENTION

1. Field of the Invention

The present invention relates to recording sheets for recording information using ink, or the like. In particular, the present invention relates to recording sheets for use with inkjet printers.

2. Description of the Related Art

Various types of printers are known for use with computers and word processors including dot matrix printers, thermal coloring printers, thermal wax printers, thermal dye sublimation printers, electrophotographic printers, and inkjet printers.

Among these printing methods, inkjet printing is known to have advantages over the other printing methods such as low printing costs, less printing noises, compactness of the printers, and fast printing speeds, and its applications have increased in recent years.

Various types of recording sheets have been proposed for use in the inkjet printing.

One example of the recording sheet for inkjet printing is denoted by reference numeral 110 in FIG. 3*a*.

The recording sheet 110 includes a transparent base sheet 111, an ink-receiving layer 112 formed on the base sheet 111, and an ink permeable layer 113 formed on the ink-receiving layer 112.

When an image is inkjet-printed on the recording sheet 110, ink 114 is injected from a nozzle of an inkjet printer onto a surface of the ink permeable layer 113 (i.e., printing surface) (FIG. 3*a*).

The ink permeable layer 113 includes a filler and a binder and thus has a porous structure formed by the filler particles and the binder. Accordingly, the ink 114, upon striking the surface of the ink permeable layer 113, penetrates into the ink permeable layer 113 in directions perpendicular to the surface of the ink permeable layer through the pores of the porous structure and is absorbed by the ink-receiving layer 112 where it is fixed.

The ink 114 fixed in the ink-receiving layer 112 is observed as dots 117 when viewed from the side of the transparent base sheet 111 that does not have the ink-receiving layer 112. The dots 117 as a whole can be observed as a printed image (FIG. 3*b*).

Recording sheets such as the above-described recording sheet 110 are widely used in recent years in applications including over-head projectors and electric light-illuminated advertisements.

Aqueous ink is generally used in the inkjet printing. Accordingly, when the ink permeable layer 113 is highly hydrophilic, the ink 114, upon striking the surface of the ink permeable layer 113, may be absorbed in directions parallel to the surface of the ink permeable layer 113 in addition to the direction perpendicular to the surface of the ink permeable layer 113.

In such cases, the amount of the ink 114 absorbed in the direction perpendicular to the surface of the ink permeable layer 113, that is, the amount of the ink 114 absorbed by the ink-receiving layer 112, is reduced. This results in a reduced color density of the dot 117 when the dot 117 is observed from the side of the base sheet 111 that does not have the ink-receiving layer 112.

Moreover, when a significant amount of the ink 114 is absorbed in directions parallel to the surface of the ink permeable layer 113, the ink 114 within the ink permeable layer 113 may overlap with each other. These overlaps may be observed as bleeds in printed images.

A type of recording sheet that has alleviated the above-mentioned problems of the conventional recording sheets is known. Such recording sheets include a porous ink permeable layer to which surfactants have been added (Japanese Patent Laid-Open Publication No. Sho 62-280068). In these recording sheets, the surfactants make the ink permeable layer more lipophilic and less hydrophilic, reducing the affinity of the ink permeable layer for the aqueous ink. This suppresses the dispersion as well as fixation of the ink within the ink permeable layer.

In general, various organic solvents are added to the ink (such as, aqueous ink) for inkjet printing in order to prevent nozzles of the inkjet printers from clogging or in order to facilitate penetration of the ink into the recording sheets. Examples of such organic solvents include polyols such as ethylene glycol, diethylene glycol, triethylene glycol, propylene glycol, polyethylene glycol, and glycerol; alkyl ether derivatives of polyols such as ethylene glycol monomethyl ether, ethylene glycol monoethyl ether, diethylene glycol monomethyl ether, diethylene glycol monoethyl ether, diethylene glycol monobutyl ether, diethylene glycol dimethyl ether, diethylene glycol diethyl ether, diethylene glycol methyl ethyl ether, triethylene glycol monomethyl ether; ester derivatives of polyols such as ethylene glycol monomethyl ether acetate, diethylene glycol monoethyl ether acetate, glyceryl monoacetate, and glyceryl diacetate; water-soluble amines such as monoethanolamine, diethanolamine, triethanolamine, and polyoxyethylene amine; and nitrogen-containing cyclic compounds such as 2-pyrrolidone, and N-methyl-2-pyrrolidone. When the ink containing these organic solvents is applied to the ink permeable layer with a high lipophilicity, the organic solvents in the ink may be dispersed along with coloring components of the ink before the ink permeates through the ink permeable layer.

SUMMARY OF THE INVENTION

In one aspect, the present invention provides a recording sheet comprising an ink-receiving layer and an ink permeable layer arranged on a surface of the ink-receiving layer, the ink permeable layer including a filler, a surfactant, and a binder, wherein the surfactant includes a fluorosurfactant having a perfluoro-alkyl group in its chemical structure, and wherein the binder containing as a primary component a water-insoluble resin having a high hydroxyl value of 4 or higher.

In one embodiment of the present invention, the filler may be silica.

In one embodiment of the present invention, the binder may include one or both of the high hydroxyl value resin that is composed of a polyester and the high hydroxyl value resin that is composed of polyvinyl acetal.

In one embodiment of the present invention, the surfactant may be added to the ink permeable layer in an amount of 1 to 30 weight parts with respect to the total weight of the binder and the filler as 100 weight parts.

In one embodiment of the present invention, the binder comprises at least one high hydroxyl value resin selected from the group consisting of polyethylene, polystyrene, polymethacrylate, elastomers, ethylene-vinyl acetate copolymer, styrene-acryl copolymer, polyacryl, polyvinyl ether, polyamide, polyolefin, polysilicone, guanamine, polytetrafluoroethylene, urea resin, phenoxy resin, epoxy resin, and styrene-butadiene rubber.

In one embodiment of the present invention, the filler comprises at least one compound selected from the group consisting of silica, talc, kaolin, clay, zinc oxide, tin oxide, aluminum oxide, calcium carbonate, titanium white, barium sulfate, titanium dioxide, aluminum silicate, magnesium silicate, magnesium oxide, smectite, zeolite, and diatomite.

In one embodiment of the present invention, the recording sheet further comprising a base sheet disposed proximate to the ink receiving layer.

In one embodiment of the present invention, the base sheet comprises at least one compound selected from the group of polyethylene terephthalate, polyesters as polyethylene naphthalate, polyolefins as polyethylene and polypropylene, polyvinyl chloride, polystyrene, polymethyl methacrylate, polycarbonate, transparent paper, cellulose acetate, polyacrylate, and polyether sulfone.

BRIEF DESCRIPTION OF THE DRAWINGS

These and other and advantages of the present invention will become apparent from the following description with reference to the accompanying drawings, wherein.

DETAILED DESCRIPTION

Ink permeable layers of recording sheets of the present invention include fluorosurfactants. When a filler, such as silica, that has hydrophilic groups exposed on surfaces of its particles is added to the ink permeable layer, the entire surface of the filler particle is covered by perfluoro-alkyl groups of the fluorosurfactant.

The ink permeable layer is rendered not only highly hydrophobic but also highly lipophobic since the fluorosurfactants include perfluoro alkyls that are both hydrophobic and lipophobic. When an aqueous ink to which organic solvents have been added is applied to the ink permeable layer, the ink is not dispersed in the ink permeable layer. Thus, images are printed with higher printing density and the bleeding in the printed image is prevented.

Water-insoluble resins having a high hydroxyl value of 4 or higher are used as a binder in the ink permeable layer. These binders do not absorb water-soluble components of the ink. Further, the binder has a low affinity for organic solvents, which are lipophilic components of the ink, since hydroxyl groups act as lipophobic groups. Accordingly, the likelihood that the printed image will be bled can be further reduced by using such binders with the fluorosurfactants.

As used herein, the term "hydroxyl value" refers to a value that indicates the amount of hydroxyl groups present in a polymeric compound such as a resin. The term is defined in Japanese Industrial Standard document JIS K 0070-1992. The hydroxyl value is given by the number of milligrams of potassium hydroxide required to neutralize an amount of acetic acid which is required to acetylate free hydroxyl groups present in one gram of a resin. Therefore, the higher the hydroxyl value (mgKOH/g) is for a compound, the larger the amount of the hydroxyl group in that compound.

A preferred embodiment of a recording sheet in accordance with the present invention as well as its production process will now be described with reference to the accompanying drawings.

First, 100 weight parts of a water-soluble urethane resin (sold under the mane NS310X available from TAKAMATSU OIL & FAT Co., Ltd.; 14 wt. % solid component), which is an ink absorbing resin, were mixed with 2.8 weight parts of aluminum hydroxide as a filler (sold under the name HIGILITE H42 available from SHOWA DENKO Co., Ltd) to form a mixture. The mixture was then stirred for 6 hours in a jar mill to produce a coating solution for an ink-receiving layer.

Figure 1A:
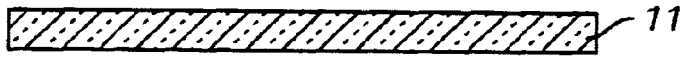
FIGS. 1*a* to 1*c* show manufacturing stages of a record sheet in accordance with the present invention.

Reference numeral 11 in FIG. 1*a* designates a transparent base sheet made of polyethylene terephthalate. In this embodiment, product available from TOYOBO Co., Ltd. sold under the name COSMOSHINE A4100 (film thickness: 100 $\mu$m, adhesion-facilitating treatment applied on one surface) was used as the base sheet 11.

Figure 1B:
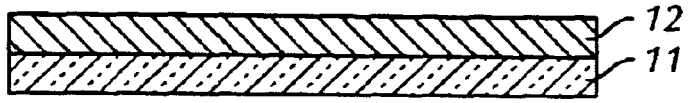

The coating fluid for an ink-receiving layer prepared in the process above was applied to a surface of the base sheet 11 using a bar coater. The coated base sheet was then dried at 120° C. in a hot-air-circulating oven for three minutes to form an ink-receiving layer 12 (FIG. 1*b*). The ink-receiving layer 12 was formed to have a thickness of 15 $\mu$m after drying.

Next, 56 weight parts of methyl ethyl ketone as an organic solvent and 14 weight parts of cyclohexanone as another organic solvent were added to 15 weight parts of a binder composed of a water-insoluble resin having a high hydroxyl value of 4 or higher. The resulting mixture was stirred for three hours in a jar mill until the binder was completely dissolved to produce a binder solution.

To 85 weight parts of this binder solution, 15 weight parts of silica, available from Mizusawa Industrial Chemicals Ltd. sold under the name MIZUKASIL P527 (average particle size 1.6 $\mu$m), and 1.5 weight parts of a fluorosurfactant suitable examples of which are described below, which has perfluoro-alkyl groups in its chemical structure, were added. The resulting mixture was then stirred in a jar mill for one hour to produce a coating fluid for an ink permeable layer.

Next, using a Mayer bar, the coating fluid for the ink permeable layer prepared in the above process was applied to a surface of the ink-receiving layer 12 shown in FIG. 1*b*. An ink permeable layer 13 was formed to have a thickness of 12 $\mu$m after drying.

Figure 1C:
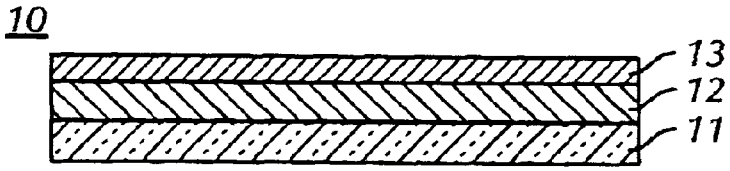

The ink permeable layer 13 was formed after drying at 120° C. in a hot-air-circulating oven for three minutes. This completed a recording sheet 10 of the present invention including the ink-receiving layer 12 and the ink permeable layer 13 (FIG. 1*c*).

EXAMPLES

Twenty different types of the recording sheets 10 were prepared using combinations of one of four types of high hydroxyl value resins and one of five types of fluorosurfactants. The components were blended with the same blending ratios and were processed in the same processes as described above. The four high hydroxyl value resins are as follows: sold under the name VYLON 220 available from TOYOBO Co., Ltd., sold under the name UE3320 from UNITIKA Ltd., sold under the name UE3360 from UNITIKA Ltd., and sold under the name KS-10 from Sekisui Chemical Co., Ltd. The five surfactants are as follows: sold under the names MEGAFACE F-177, MEGAFACE F-171, MEGAFACE F-172 all available from DAINIPPON INK AND CHEMICALS Co., Ltd., sold under the names SURFLON S-393 and SURFLON S-381 available from Asahi Glass Company.

Using the recording sheets 10 so prepared, printed images were evaluated as follows.

[Rating of Printed Images]

An inkjet printer model FJ-40 manufactured by ROLAND Co., LTD was used and aqueous pigment ink was injected from a nozzle of the inkjet printer onto a surface of the ink permeable layer 13 of the recording sheet 10 to form a predetermined image. The predetermined image was formed such that 6 point outlined Gothic font characters were arranged in a solid background.

These images were evaluated on the following scale: a circle indicates that the outlined characters on the sheet were clearly legible, a triangle indicates that the outlined characters on the sheet were partially bled, and a cross indicates that the outlined characters were bled and illegible. The evaluations of the images and the combinations of the high hydroxyl value resins and the surfactants used in the ink permeable layer 13 are shown in Table 1 below.

TABLE 1

Combinations of fluorosurfactants and high hydroxyl value resins and the evaluations of printed images

| | | | High hydroxyl value resin | | | |
|---|---|---|---|---|---|---|
| | | | Polyester | | | Polyvinyl acetal |
| | | | Vylon 220 | UE3320 | UE3360 | KS-10 |
| Examples of present invention | fluorosurfactant | MEGAFACE F-177 | Δ | Δ | Δ | Δ |
| | | MEGAFACE F-171 | Δ | ○ | Δ | Δ |
| | | MEGAFACE F-172 | ○ | ○ | ○ | ○ |
| | | SURFLON S-393 | ○ | Δ | ○ | ○ |
| | | SURFLON S-381 | Δ | Δ | Δ | Δ |

Of the four types of the high hydroxyl value resins used in the above examples, the products VYLON 220, UE3320, and UE3360 are polyesters, and the product KS-10 is a polyvinyl acetal. The hydroxyl values, grass transition temperatures, and molecular weights of these high hydroxyl value resins are shown in Table 2 below.

TABLE 2

Hydroxyl values, glass transition temperatures, and molecular weights of high hydroxyl value resins

| Composition | Name | Hydroxyl value | Glass transition temperature (° C.) | Molecular weight |
|---|---|---|---|---|
| Polyester | Vylon 220 | 45 | 53 | 2500 |
| | UE3320 | 60 | 40 | 2000 |
| | UE3360 | 25 | 60 | 5000 |
| Polyvinyl acetal | KS-10 | 256 | 106 | Unknown |

* Hydroxyl value: mgKOH/g

As can be seen from Table 1, the outlined characters formed on the printed images were legible for all of the recording sheets 10, irrespective of the type of the combination of the high hydroxyl value resin and the surfactant, in the above examples of the present invention. Thus, the ink permeable layer 13 of the recording sheets 10 in accordance with the present invention proved to have a practically sufficient ink phobicity.

COMPARATIVE EXAMPLES

Sixteen different types of the recording sheets were prepared in the same manner as in the examples by using combinations of one of four types of nonionic surfactants, which were used in place of the fluorosurfactants in the above-described examples of the present invention, and one of the four types of high hydroxyl value resins that were used in the examples.

The four nonionic surfactants were as follows: polyoxyethylene oleyl ether manufactured by NOF Corporation sold under the name E202S, sorbitan monooleate manufactured by NOF Corporation sold under the name OP-80R, sorbitan trioleate manufactured by NOF Corporation sold under the name OP-85R, and sorbitan monolaurate manufactured by NOF Corporation sold under the name LP-20R.

Using the recording sheets of the comparative examples, printed images were evaluated in the same manner as in the examples. The results are shown in Table 3 below.

TABLE 3

Combinations of nonionic surfactants and high hydroxyl value resins and the evaluations of printing images

| | | | Hydroxyl value resin | | | |
|---|---|---|---|---|---|---|
| | | | Polyester | | | Poly-vinyl acetal |
| | | | Vylon 220 | UE3320 | UE3360 | KS-10 |
| Comparative examples | Nonionic surfactants | E202S | x | x | Δ | x |
| | | OP-80R | x | x | Δ | x |
| | | OP-85R | x | x | x | x |
| | | LP-20R | x | x | x | x |

As can be seen from Table 3 above, the outlined characters were illegible in most of the recording sheets of the comparative examples that used nonionic surfactants.

For reference, the HLB values for two of the fluorosurfactants used in the examples and the HLB values for the four nonionic surfactants used in the comparative examples above are presented in Table 4.

TABLE 4

HLB value of surfactants

| | Name | HLB value |
|---|---|---|
| Nonionic surfactants | LP-20R | 8.6 |
| | OP-80R | 4.3 |
| | OP-85R | 1.8 |
| | E202S | 4.9 |
| fluorosurfactants | SURFLON S-393 | 1.9 |
| | SURFLON S-381 | 4.7 |

While it is believed that, in general, surfactants with higher HLB values have higher hydrophilicity and surfactants with lower HLB values have higher lipophilicity, there was a significant difference, as seen from Tables 1, 3, and 4, in the ink phobicity of the ink permeable layer, between the examples of the present invention which used the fluorosurfactants, and the comparative examples which used the nonionic surfactants despite the fact that both types of surfactants may have similar HLB values.

EXAMPLES

Three types of the recording sheets in accordance with the present invention were prepared in the same manner as in the above-described examples by using, in combination, two types of water-insoluble polyesters and the two types of fluorosurfactants. The two types of water-insoluble polyesters have different hydroxyl values and were used in place of the high hydroxyl value resins used in the above-described examples.

The two types of water-insoluble polyesters were VYLON 200 available from TOYOBO Co., Ltd (molecular weight: 17000, glass transition temperature: 67° C.) and UE3210 from UNITIKA Ltd (molecular weight: 20000, glass transition temperature: 45° C.). The two types of the fluorosurfactants were MEGAFACE F-172 available from DAINIPPON INK AND CHEMICALS Co., Ltd. and SURFLON S-393 available from Asahi Glass Company.

Using the three types of the recording sheets 10, printed images were evaluated in the same manner as in the above-described examples. The evaluations of the images and the combinations of the high hydroxyl value resins and the surfactants, as well as the hydroxyl values for the high hydroxyl value resins, are shown in Table 5 below.

TABLE 5

Combinations of high hydroxyl value resins and fluorosurfactants and the evaluations of printed images

| fluorosurfactants | High hydroxyl value resin (Hydroxyl value) | Evaluation of printed image |
|---|---|---|
| MEGAFACE F-172 | Vylon 200 (Hydroxyl value: 6) | Δ |
| | UE3210 (Hydroxyl value: 4) | Δ |
| SURFLON S-393 | Vylon 200 (Hydroxyl value: 6) | Δ |

* Hydroxyl value: mgKOH/g

As can be seen from Table 5, though partially bled, the outlined characters were legible in each case where the water-insoluble polyester with the hydroxyl value of 4 or higher was used. Accordingly, the ink permeable layer 13 of the recording sheets 10 proved to have a practically sufficient ink phobicity.

EXAMPLES

Among those used in the examples above, one high hydroxyl value resin (i.e., VYLON 220 manufactured by TOYOBO Co. Ltd.) and one surfactant (i.e., MEGAFACE F-172 manufactured by DAINIPPON INK AND CHEMICALS Co., Ltd.) were used to prepare seven different coating fluids for the ink permeable layer, in which the amount of the surfactant was varied as shown in Table 6 with respect to the total weight of 100 (weight parts) of the high hydroxyl value resin and the filler. Seven types of the recording sheets 10 were made by using the seven coating fluids. The recording sheets 10 so prepared were used to evaluate the printed images in the same manner as in the above-described examples. Also, printing densities were tested as follows.

[Test for Printing Densities]

The same inkjet printer as that used in the evaluation of the printed images was used to jet aqueous pigment ink onto a surface of the ink permeable layer 13 of the recording sheet 10 of the example to form a solid black image. Using a reflection densitometer (model TR-924 manufactured by MACBETH Co. Ltd.), the printing density (or reflection density) was measured on the surface of the recording sheet 10 which does not have the ink-receiving layer 12 and the ink permeable layer 13. The images were evaluated with respect to the printing density on the following scale: a circle indicates the printing densities of 2.0 or higher, a triangle indicates the printing densities of 1.5 or higher and lower than 2.0, and a cross indicates the printing densities less than 1.5.

The evaluations of the printed images and the printing densities are shown in Table 6 below.

TABLE 6

The amounts of fluorosurfactant and the test results

| fluorosurfactant | Amount (weight parts) | Evaluation of printed image | Evaluation of printing density |
|---|---|---|---|
| MEGAFACE F-172 | 0.5 | x | ○ |
| | 1 | Δ | ○ |
| | 3 | ○ | ○ |
| | 5 | ○ | ○ |
| | 20 | ○ | ○ |
| | 30 | ○ | Δ |
| | 35 | x | x |

* The amount with inspect to the total amount of the binder and the filler contained in the ink permeable layer as 100 weight parts.

As can be clearly seen from Table 6 above, the recording sheets 10 to which 1 to 30 weight parts of the fluorosurfactant had been added had sufficiently high printing densities of 1.5 or higher. Also, the evaluations of the printed images were excellent.

In contrast, in the evaluation of the printed images, the outlined characters were illegible for the recording sheets 10 to which less than 1 weight part of the fluorosurfactant had been added or for the recording sheets 10 to which more than 30 weight parts of the fluorosurfactant had been added. In particular, the printing densities were low when the amount of the surfactant was 35 weight parts.

Accordingly, it is considered that the amounts of the fluorosurfactant that are less than about 1 weight part are not large enough to make the ink permeable layer 13 sufficiently hydrophobic and lipophobic. It is considered that the amounts greater than about 30 weight parts of the fluorosurfactant make the ink permeable layer excessively hydrophobic and lipophobic and the ink is repelled at the surface of the ink permeable layer and does not penetrate into the ink permeable layer, when applied to the surface of the recording sheet.

While polyethylene terephthalate is used as the material for the base sheet 11 in the above-described examples, the use of other materials as a base sheet is specifically within the scope of the present invention.

Materials that can be used for the base sheet 11 include polyesters such as polyethylene naphthalate, polyolefins such as polyethylene and polypropylene, polyvinyl chloride, polystyrene, polymethyl methacrylate, polycarbonate, transparent paper, cellulose acetate, polyacrylate, and polyether sulfone.

Preferably, the material for the base sheet 11 may be polyethylene terephthalate, hardened polyvinyl chloride, polypropylene, or triacetate for recording sheets for use with over-head projectors.

While one embodiment has been described in which the ink-receiving layer 12 is formed on the surface of the base sheet 11, the present invention is not limited to such an embodiment.

Provided that the ink-receiving layer 12 has a sufficient strength, base sheet 11 may be dispensed with.

Figure 2:
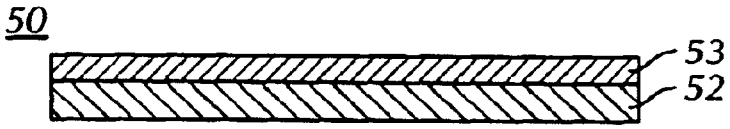
FIG. 2 shows a two layered recording sheet according to another embodiment of the present invention.
Figure 3A:
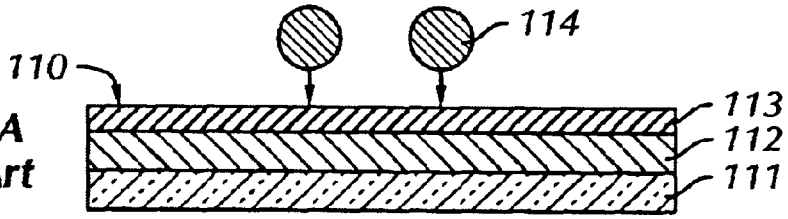
FIG. 3A Prior Art
FIGS. 3*a* and 3*b* show the printing process using conventional recording sheets for inkjet printing.
Figure 3B:
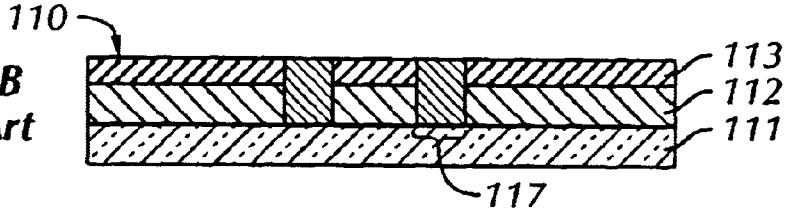
FIG. 3B Prior Art
Figure 4:
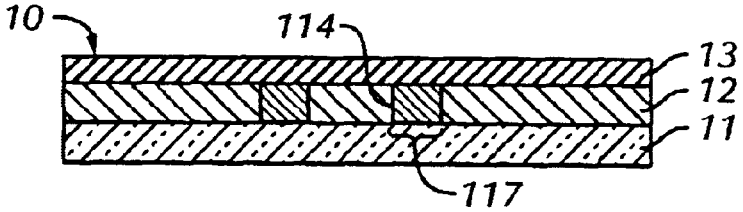

Another embodiment of the recording sheet in accordance with the present invention is denoted by a reference numeral 50 in FIG. 2. The recording sheet 50 includes an ink-receiving layer 52 and an ink permeable layer 53 formed on the surface of the ink-receiving layer 52 without a base sheet.

While other materials may be used, the ink-absorbing resins used in the ink-receiving layer 12 may preferably be water-soluble resins having the ability to swell or hydrophilic polymers for the purpose of absorbing and fixing aqueous ink. Examples of suitable ink-absorbing resins include, but are not limited to, natural resins such as albumin, casein, starch, gum arabic, and sodium alginate, synthetic resins such as carboxymethyl cellulose, hydroxyethyl cellulose, polyamide, polyethylene imine, polyvinyl pyrrolidone, polyvinyl alcohol, polyvinyl acetal, melamin, polyester, polyacryl, polyurethane, and polyallyl amine.

While aluminum hydroxide may preferably be used as a filler in the ink-receiving layer 12, other materials may also be used including silica, talc, kaolin, clay, zinc oxide, tin oxide, aluminum oxide, calcium carbonate, titanium white, barium sulfate, titanium dioxide, aluminum silicate, magnesium silicate, magnesium oxide, smectite, zeolite, and diatomite.

Silica is used as a filler to be added to the ink permeable layer 13 in the above-described examples. While the use of other materials is also within the scope of the present invention, permeability of the ink permeable layer 13 to ink is reduced when titanium oxide, such as titanium white, is added to the ink permeable layer 13. As a result, the densities of the printed image are reduced, and for this reason, titanium oxide is not suitable for use with the present invention.

Also, while polyesters and polyvinyl acetals may preferably be used as the high hydroxyl value resin in the ink permeable layer 13, other high hydroxyl value resins that are water-insoluble and have the hydroxyl value of 4 or higher may also be used. Such high hydroxyl value resins include polyethylene, polystyrene, polymethacrylate, elastomers, ethylene-vinyl acetate copolymer, styrene-acryl copolymer, polyacryl, polyvinyl ether, polyamide, polyolefin, polysilicone, guanamine, polytetrafluoroethylene, urea resin, phenoxy resin, epoxy resin, and styrene-butadiene rubber.

While Mayer bars and bar coaters may preferably be used to apply the coating solutions of the ink permeable layer and ink-receiving layer in accordance with the present invention, various other coating equipment may also be used including knife coaters and gravure coaters.

While the ink-receiving layer 12 and ink permeable layer 13 may have various thickness, preferably they have a thickness in the range of 1 $\mu$m to 50 $\mu$m.

As has been described, the present invention provides recording sheets that are less susceptible to bleeding of the printed images and provide improved color densities.

While reference has been made to specific present embodiments of the invention, it will be understood that various modifications may be made thereto, and it is intended that the appended claims cover all such modification as fall within the true spirit and scope of the invention.

What is claimed is:

1. A recording sheet comprising an ink-receiving layer and an ink permeable layer arranged on a surface of the ink-receiving layer, said ink permeable layer comprising a filler, a surfactant, and a binder, said surfactant comprising a fluorosurfacant having perfluoro-alkyl group in its chemical structure, said binder comprising a water-insoluble resin having a high hydroxyl value of 4 or higher, wherein said water-insoluble resin is a polyester resin.

2. The recording sheet according to claim 1, wherein said filler is silica.

3. The recording sheet according to claim 1, wherein said surfactant is added to said ink permeable layer in an amount of from about 1 to about 30 weight parts with respect to the total weight of the binder and the filler as 100 weight parts.

4. The recording sheet according to claim 2, wherein said surfactant is added to said ink permeable layer in an amount of from about 1 to about 30 weight parts with respect to the total weight of the binder and the filler as 100 weight parts.

5. The recording sheet according to claim 1, wherein the filler comprises at least one compound selected from the group consisting of silica, talc, kaolin, clay, zinc oxide, tin oxide, aluminum oxide, calcium carbonate, titanium white, barium sulfate, titanium dioxide, aluminum silicate, magnesium silicate, magnesium oxide, smectite, zeolite, and diatomite.

6. The recording sheet according to claim 1, further comprising a base sheet disposed proximate to the ink receiving layer.

7. The recording sheet according to claim 6, wherein the base sheet comprises at least one compound selected from the group of polyethylene terephthalate, polyesters as polyethylene naphthalate, polyolefins as polyethylene and polypropylene, polyvinyl chloride, polystyrene, polymethyl methacrylate, polycarbonate, transparent paper, cellulose acetate, ployacrylate, and polyether sulfone.

8. The recording sheet according to claim 1, wherein said polyester resin has a molecular weight from 2,000 to 5,000.

9. The recording sheet according to claim 1, wherein said ink permeable layer is hydrophobic and lipophobic so as to not disperse an aqueous ink to which an organic solvent as lipophilic component has been added, said receiving layer has ink-absorbing resin so as to absorb and fix said aqueous ink.

10. The recording sheet according to claim 1, further comprising an aqueous ink fixed in said ink-receiving layer after penetrating through said ink permeable layer, wherein said aqueous ink contains an organic solvent which is a lipophilic component.

* * * * *